United States Patent [19]

Atchisson

[11] 4,297,800

[45] Nov. 3, 1981

[54] CARTRIDGE MAGAZINE FOR FIREARMS

[76] Inventor: Maxwell G. Atchisson, 55 Old Yellow Springs Rd., Fairborn, Ohio 45324

[21] Appl. No.: 69,725

[22] Filed: Aug. 27, 1979

Related U.S. Application Data

[62] Division of Ser. No. 830,607, Sep. 6, 1977, Pat. No. 4,169,329.

[51] Int. Cl.[3] ..... F41C 25/02

[52] U.S. Cl. ..... 42/49 A

[58] Field of Search ..... 42/49 A, 50, 18, 22

[56] References Cited

U.S. PATENT DOCUMENTS

| | | | |
|---|---|---|---|
| 1,407,633 | 2/1922 | Burton | 42/49 A |
| 2,396,816 | 3/1946 | Boudreau | 42/49 A |
| 3,776,095 | 12/1973 | Atchisson | 42/49 A |
| 4,058,922 | 11/1977 | Elbe et al. | 42/49 A |
| 4,069,608 | 1/1978 | Jurek | 42/49 A |
| 4,139,958 | 2/1979 | Foote | 42/49 A |

FOREIGN PATENT DOCUMENTS

| | | | |
|---|---|---|---|
| 148470 | 1/1955 | Sweden | 42/50 |
| 241688 | 8/1946 | Switzerland | 42/50 |

*Primary Examiner*—Charles T. Jordan

*Attorney, Agent, or Firm*—Jones, Thomas & Askew

[57] ABSTRACT

Apparatus for converting a firearm of a first caliber to fire cartridges of a second caliber. The regular bolt assembly of the firearm is removed and replaced with a conversion bolt assembly having a flat receiver plate which is bifurcated to provide a pair of flat rails. A bolt assembly is supported for movement along the rails, out of contact with the receiver of the firearm. The receiver plate of the conversion bolt assembly extends forwardly from a backplate which accurately locates the conversion assembly within the firearm, and the receiver plate is tilted to clear the conventional ejection port of the firearm. The conversion bolt assembly includes an automatic sear trip which enables full-automatic firing of second caliber cartridges on firearms that are so equipped, and also includes a weight for improved full-automatic operation. The disclosed embodiment is designed for use with an M-16 or AR-15 rifle.

Also disclosed is a cartridge magazine having an elongated channel to receive a plurality of cartridges in a single column and in staggered relation to each other. The rim of each cartridge in the channel is laterally offset in relation to the immediately adjacent cartridges. The cartridge receiving channel is curved forwardly on a radius in front of the magazine, so that cartridges have the same relation to each other in the magazine irrespective of magazine length or the number of cartridges received therein.

4 Claims, 16 Drawing Figures

CARTRIDGE MAGAZINE FOR FIREARMS

This is a division of application Ser. No. 830,607, filed Sept. 6, 1977, now U.S. Pat. No. 4,169,329.

This invention relates in general to firearms and in particular to apparatus for converting a rifle to fire a cartridge other than the cartridge for which the rifle is chambered.

Rifles and other firearms are designed to fire cartridges of a particular caliber, as determined by two aspects of the firearm. One such aspect is the diameter of the barrel through which the projectile must pass. The other aspect is the configuration and size of the cartridge-receiving chamber within the firearm. Those skilled in the art know that a firearm which is chambered to receive a cartridge of a particular caliber cannot safely be fired with a cartridge of a different caliber, unless the firearm has been suitably modified.

It is frequently desirable to modify a rifle or other weapon of existing caliber so as to use subcaliber ammunition for various purposes. This need is particularly apparent in the case of firearms such as the M-16 rifle, which has become the standard U.S. infantry rifle and which is also widely used by other governmental agencies. Although the M-16 rifle is chambered for a 5.56 mm cartridge, the bore of the barrel will accept the slug of a conventional 0.22 long rifle rim fire cartridge. Since the cost of 0.22 ammunition is substantially less than that of the 5.56 mm cartridge, it would be much less expensive to use 0.22 ammunition while training recruits and others to shoot the M-16 rifle. Furthermore, it may be desirable in certain types of operations to utilize the relatively lower muzzle velocity of 0.22 ammunition while retaining the operational familiarity of the conventional M-16 rifle.

Subcaliber conversion devices have been proposed for use with various types of firearms, including the M-16 rifle. One example of apparatus for converting a M-16 (or its civilian counterpart, the AR-15 rifle) to fire standard 0.22 ammunition is shown in U.S. Pat. No. 3,776,095. While the conversion device of that patent is effective, the device is relatively expensive to manufacture and requires close attention to production tolerances. Other 0.22 conversion devices for the M-16 rifle have been designed and tested, but such devices suffer from various manufacturing and/or operational deficiencies which have prevented the general acceptance of any such conversion device.

Accordingly, it is an object of the present invention to provide an improved firearm subcaliber conversion apparatus.

It is another object of the present invention to provide improved apparatus for converting a firearm to utilize 0.22 rim fire ammunition.

It is still another object of the present invention to provide a 0.22 rim fire conversion apparatus for use with M-16 and AR-15 rifles.

Stated in general terms, the conversion apparatus of the present invention comprises a conversion bolt assembly which is substituted for the regular bolt assembly of a firearm such as the M-16 or AR-15 rifle. The conversion bolt assembly has a unitary flat receiver plate with a backing plate permanently affixed to one end thereof, and with the other end bifurcated by a slot to define a pair of longitudinally-extending parallel rails. The receiver plate may be laterally dimensioned to contact the interior of the upper receiver in an M-16 so as to positively locate the conversion bolt assembly apparatus therein.

A sliding bolt assembly is carried and guided by the two parallel rails to keep the bolt assembly out of sliding contact with the receiver of the rifle. The bolt assembly has slots for receiving the parallel rails of the receiver plate, and includes a self-contained recoil spring which urges the bolt forwardly. A barrel assembly is held in place between the open ends of the parallel rails, which are sufficiently resilient to be separated for assembly or disassembly of the conversion apparatus, and the barrel assembly includes an insert portion which fits within the chamber of the rifle to be converted.

An anti-bounce weight and an automatic sear trip are included with the present conversion apparatus, enabling full-automatic firing of 0.22 cartridges in a weapon such as the M-16 which is designed for full-automatic firing.

The nature of the present invention, as well as other objects and advantages thereof, will become more readily apparent from the following description of the disclosed preferred embodiment as shown in the drawings, in which.

Figures 1, 3A:
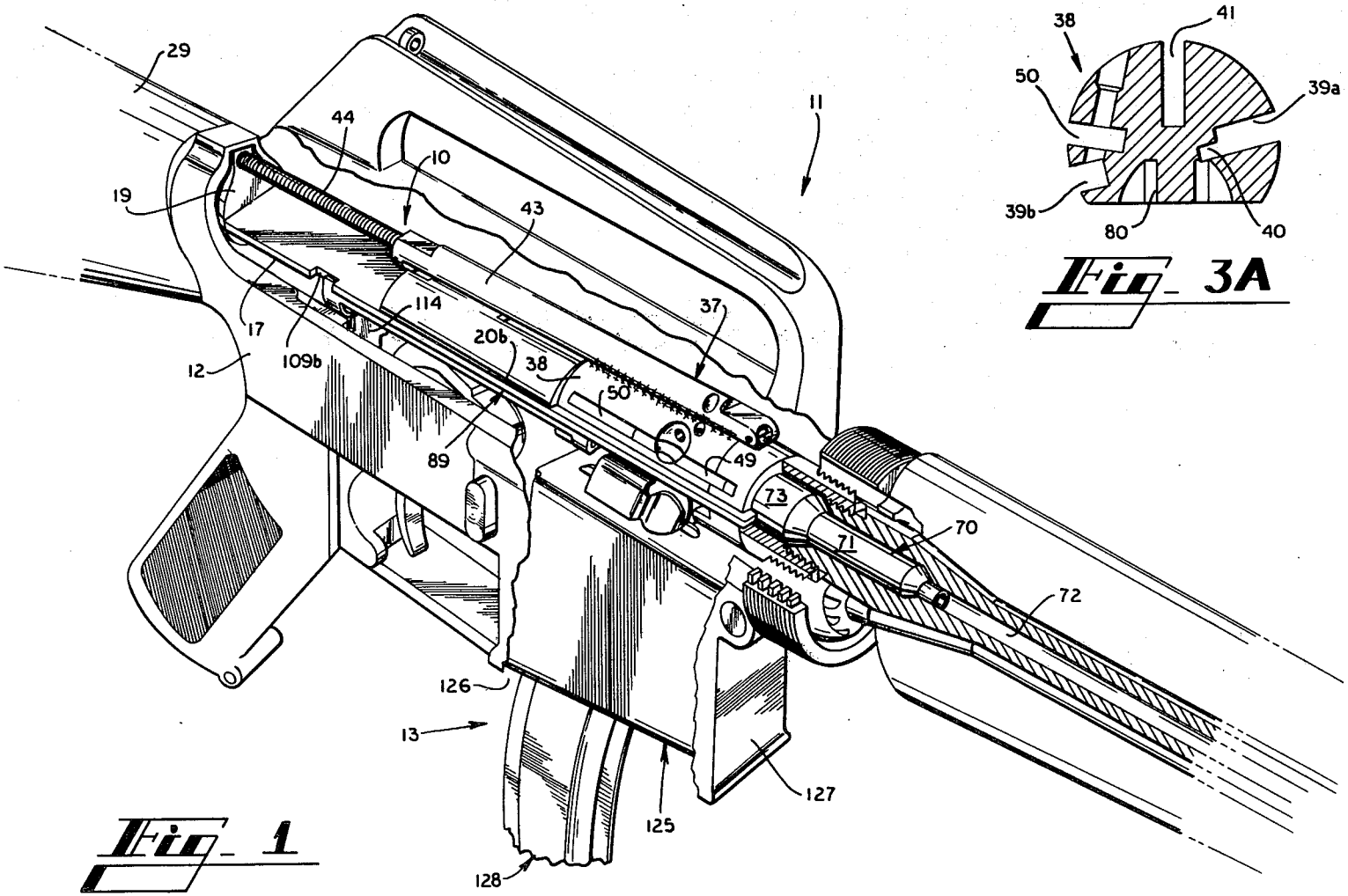
FIG. 1 shows a pictorial view of the disclosed embodiment of the present weapon conversion apparatus as installed in a M-16 rifle which is depicted fragmentarily partially and broken-away for clarity.
FIG. 3A is a sectioned elevation view of the bolt body used in the disclosed embodiment.

Turning to FIG. 1, there is shown generally at 10 a conversion bolt assembly apparatus according to the present invention, which is shown installed in a conventional M-16 rifle 11 in place of the regular bolt assembly with which the rifle is normally equipped. Many conventional details of the M-16 rifle are omitted from FIG. 1, since that rifle is depicted only to show the installation and operation of the present conversion apparatus. Also shown in FIG. 1 is the conversion magazine 13 which is substituted for the conventional 5.56 mm magazine normally used with the M-16.

Figure 2:
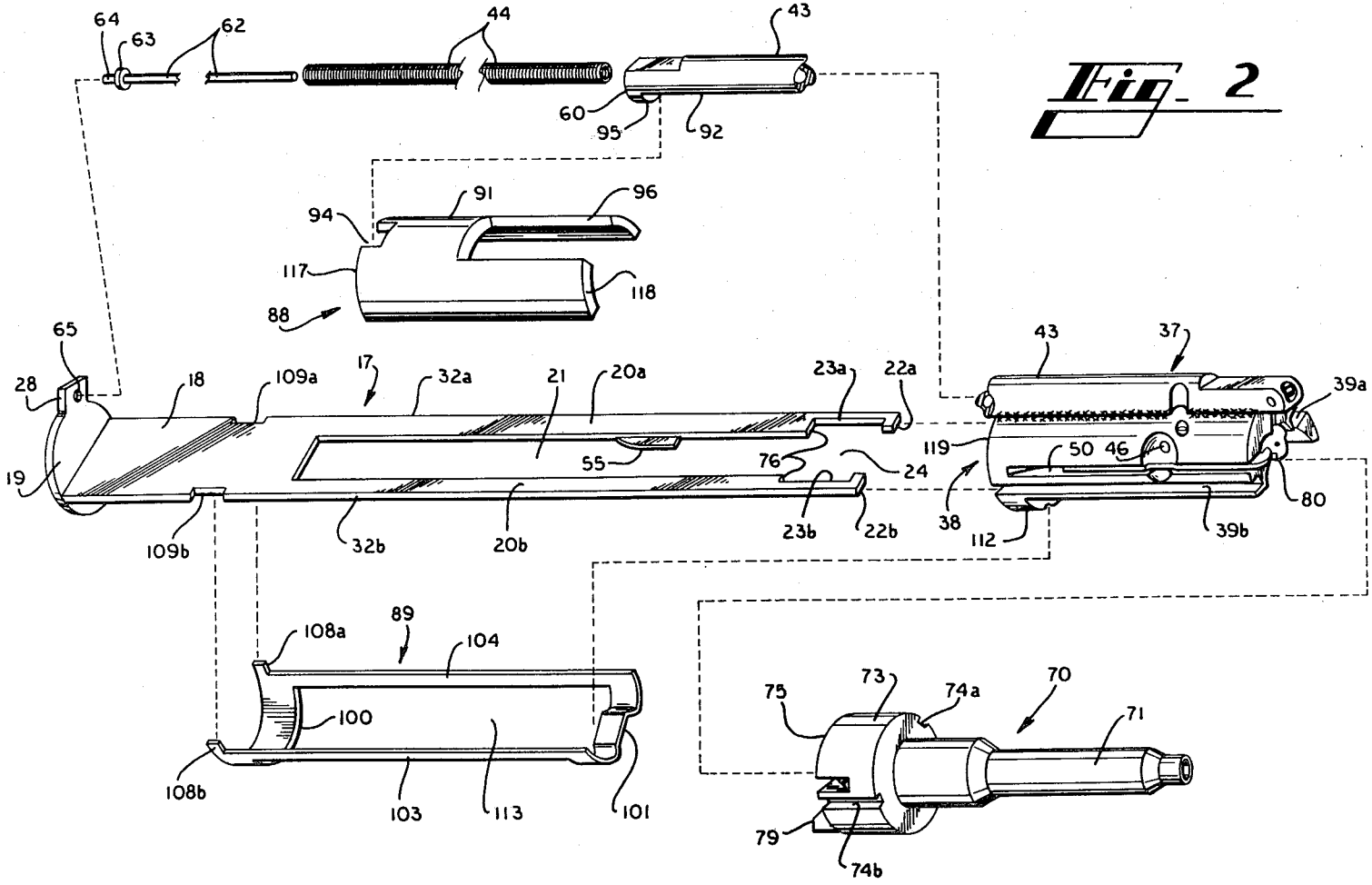
FIG. 2 shows an exploded view of the embodiment shown in FIG. 1.
Figure 4:
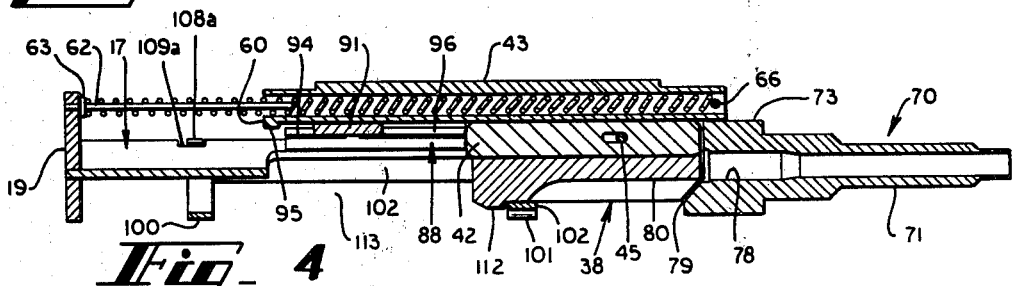
FIG. 4 is a side elevation section view taken along line 4—4 of FIG. 3, with the anti-bounce weight depicted in phantom for clarity.
Figure 5:
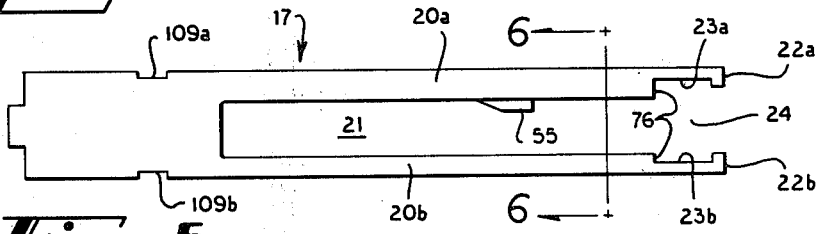
FIG. 5 is a plan view showing the receiver plate of the disclosed embodiment.
Figure 8:
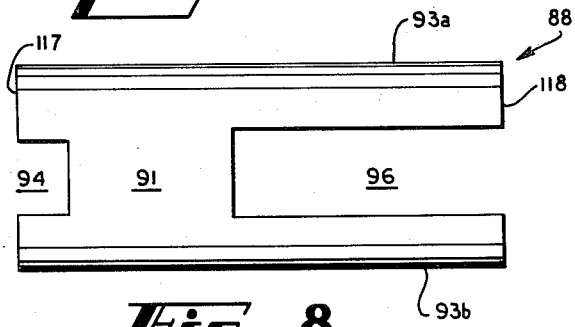
FIG. 8 is a top plan view showing the anti-bounce weight.
Figure 9:
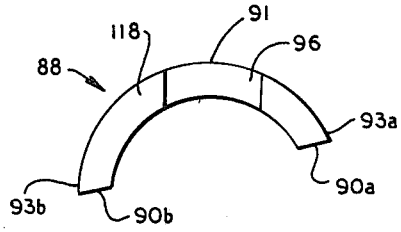
FIG. 9 is an elevation view of the anti-bounce weight, seen from the right side of FIG. 8.
Figure 10:
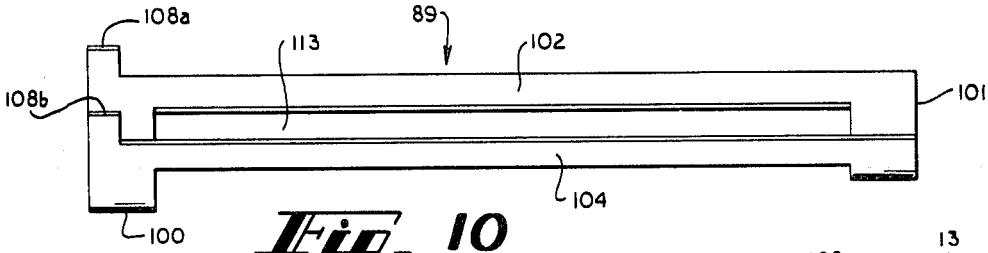
FIG. 10 is a side elevation view of the trip for the automatic sear.

The individual components which make up the conversion apparatus 10 are best seen in the exploded view of FIG. 2, and in the sectioned assembly view of FIG. 4. The conversion apparatus has a flat receiver plate 17 having a solid back portion 18 which is affixed to a backplate 19. The portion of the receiver plate 17 which extends forwardly from the back portion 18 is bifurcated to provide two flat parallel rails 20*a* and 20*b* which surround and define the longitudinally-extending slot 21. The rails 20*a* and 20*b* terminate at ends 22*a* and 22*b* which are remote from the backplate 19. Notches 23*a* and 23*b*, respectively, are formed in the rails 20*a* and 20*b* adjacent the ends 22*a*, 22*b* thereof, and the notches are mutually confronting so as to define the recess 24 for receiving the barrel assembly. As is apparent from FIG. 5, the lateral width of the rail 20*a* is somewhat greater than that of the rail 20*b*, so that the depth of the notch 23*a* is accordingly greater to laterally center the barrel-receiving recess 24 on the receiver plate 17.

The backplate 19 is generally circular except for an upstanding lug 28 which is configured to be received within an existing recess contained in the upper receiver 12 of the M-16 rifle. The backplate 19 is thus positioned immediately in front of the conventional M-16 buffer assembly (not shown) which remains in place within the stock 29 of the rifle. The buffer assembly thus serves only to maintain the entire conversion assembly 10 urged forwardly into the upper receiver of the rifle, as will become more apparent below.

Figure 3:
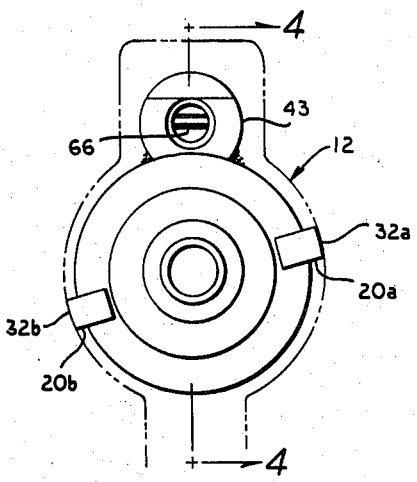
FIG. 3 shows an end elevation view of the disclosed embodiment, seen from the barrel end.
Figure 6:
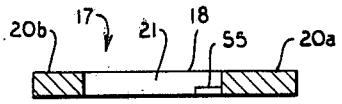
FIG. 6 is a section view taken along line 6—6 of FIG. 5, showing details of the ejector.

As best seen in FIGS. 1, 2, and 4, the forked receiver plate 17 is attached to the backplate 19 at an angle which is tilted from horizontal. This angular positioning of the receiver plate 17 causes the rail 20*b*, which extends along the right side of the upper receiver 12, to be placed lower than the left-side rail 20*a*, as particularly shown in FIG. 3. The right-side rail 20*b* is thus positioned below the ejection port (not shown) of the M-16 rifle, so that the rail cannot interfere with ejection of spent cartridges. The width of the receiver plate 17 is dimensioned so that the outer edges 32*a* and 32*b* of the receiver plate contact the confronting interior surface of the upper receiver 12, shown in phantom in FIG. 3, and the outer edges 32*a* and 32*b* may be optionally rounded as shown in FIG. 3 to conform with the contour of the receiver surface. The lateral position of the conversion apparatus 10 within the upper receiver 12 is thus assured with a sliding fit, and the aforementioned lug 28 on the backplate 19 provides the proper angular orientation of the conversion apparatus about the longitudinal axis of the rifle.

The conversion apparatus 10 further includes a sliding bolt assembly 37 which is supported for travel on the rails 20*a* and 20*b*. The bolt assembly 37 includes a bolt body 38 having a pair of longitudinally extending slots 39*a* and 39*b* which support the bolt assembly for travel on the two rails 20*a* and 20*b*. The diameter of the bolt body 38 is less than the lateral dimension across the rail edges 32*a* and 32*b*, as best seen in FIG. 3, so that the bolt assembly 37 is supported and guided by the rails to be out of contact with the upper receiver 12 as the bolt travels back and forth along the receiver plate 17. This manner of mounting the bolt assembly 37 provides a relatively low-friction travel to the bolt assembly, and assures that the upper receiver of the M-16 will not be contacted and damaged by travel of the conversion assembly bolt.

A firing pin 42, seen in FIG. 4, is received within a longitudinally-extending slot 41 (FIG. 3A) which is machined downwardly from the upper surface of the bolt body 38 and which is obscured from view in FIGS. 1 and 2 by the tubular housing 43 for the recoil spring 44. Longitudinal travel of the firing pin 42 within the bolt body 38 is controlled by the pin 45, which extends through a slot in the firing pin. The pin 45 is installed in the bolt body 38 through the opening 46, shown in FIG. 2.

Figure 7:
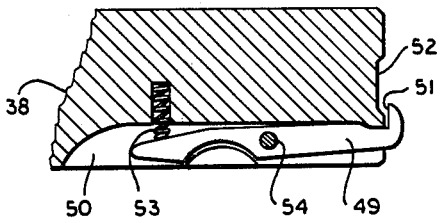
FIG. 7 is a partial section view of the bolt assembly, showing details of the extractor.

An extractor 49 is positioned within a slot 50 contained in the right side of the bolt body 38. The extractor 49 has a hooked end 51 which extends a short distance in front of the cartridge-receiving head 52 of the bolt body 38, as best seen in FIG. 7, and the spring 53 biases the extractor about the pivot 54 in the conventional manner.

The extractor 49 operates in conjunction with the ejector 55 which extends inwardly into the slot 21 from the left-side rail 20*a*. The ejector 55 is fixed and integral with the rail 20*a*, and may be formed by machining downwardly from the upper surface of that rail. The ejector 55 is slidably received in the ejector slot 40, which is formed as an extension of the slot 39*a* within the bolt body 38.

The previously-mentioned recoil spring housing 43 is welded to the top of the bolt body 38, and extends rearwardly to a back end 60 which is well behind the back of the bolt body 38. The spacing between the back end 60 of the spring housing 43 and the back plate 19 is chosen to define the maximum recoil travel of the bolt assembly 37. A spring guide rod 62 extends forwardly from the lug 28 of the backplate 19 and extends a distance into the spring housing 43 to provide guidance and support for the recoil spring 44. The guide rod 62 is formed with a bushing 63 adjacent its back end 64, and is removably fitted within the opening 65 in the lug 28. The force of the recoil spring 44, acting between the bushing 63 and the spring stop pin 66 or other impediment formed in the forward end of the spring housing 43, retains the spring guide rod 62 in assembly, yet permits ready removal of the rod and the spring during cleaning or other disassembly of the conversion assembly 10.

The conversion assembly 10 further includes a barrel assembly 70 which, in the disclosed embodiment, is a unitary item that is machined from a solid piece of steel. The barrel assembly 70 includes a short barrel member 71 having an exterior configuration which resembles the casing of a conventional 5.56 mm round, and which thus fits snugly within the chamber of an M-16 barrel 72 as shown in FIG. 1. The barrel assembly 70 further includes a main body portion 73 having a pair of slots 74*a* and 74*b* machined into opposite sides, with spacing such that the slots engage the notches 23*a* and 23*b* formed in the receiver plate side rails. The back face 75 of the barrel body 73 abuts against the forwardly-facing surfaces 76 which define the rear of the barrel recess 24 in the receiver plate 17, so that the barrel assembly 70 is maintained in the proper longitudinal position within the M-16 rifle, relative to the remainder of the conversion assembly 10, when the conversion assembly is inserted in the rifle. The barrel assembly 70 is positioned within the barrel recess 24 by resiliently spreading apart the rails 20*a* and 20*b* to position the body portion 73 within the barrel recess, and then releasing the rails; the notches 23*a* and 23*b* fit loosely within the corresponding slots 74*a* and 74*b* on the barrel body. The forward ends 22*a* and 22*b* of the rails 20*a* and 20*b* effectively form lugs which hold the barrel assembly in assembly on the receiver plate 17, when the entire conversion assembly 10 is removed from the rifle.

The interior of the barrel assembly 70 is chambered as at 78 in FIG. 4, to receive the subcaliber cartridge such as the conventional 0.22 long rifle rim fire cartridge. A feed ramp 79 is provided on the back face 75 of the barrel body 73, below the chamber 78. It is also seen in FIG. 4 that the underside of the bolt body 38 has a downwardly-extending spline 80 which functions in the conventional manner to strip the top round from the magazine and feed the round into the chamber 78, as the bolt travels forwardly during cocking or firing.

The disclosed embodiment 10 of conversion apparatus as described thus far is capable of converting either an M-16 or a Ar-15 rifle to fire 0.22 caliber ammunition semiautomatically. The conversion is accomplished by removing the regular bolt assembly from the rifle and replacing with the conversion bolt assembly apparatus 10. The conventional buffer and recoil spring remains in the rifle, and the buffer abuts the backplate 19 to urge the entire conversion assembly 10 forwardly so that the barrel member 71 fits snugly within the chamber of the rifle. The forward end of the conventional M-16/AR-15 charging handle (not shown) projects downwardly in front of the forward end of the spring housing 43, so that the bolt assembly 37 can be moved backwardly by the charging handle to cock the hammer, and then moved forwardly by the recoil spring 44 to feed a round from the conversion magazine 13 into the chamber 78 of the barrel assembly 70. When the trigger of the rifle is pulled, the conventional rifle hammer strikes the firing pin 42 to fire the chambered round, and recoil from the round forces the bolt assembly 37 rearwardly to the maximum extent permitted by contact of the spring housing back end 60 with the backplate 19. The spent casing is extracted and ejected at this time, and the bolt assembly then moves forwardly to chamber a fresh round. The next round may be fired semiautomatically by again pulling the trigger of the rifle. The rifle is readily re-converted to fire conventional ammunition simply by replacing the conversion bolt assembly apparatus 10 with the regular bolt assembly, and inserting a conventional magazine. The conversion apparatus 10 is easily disassembled for cleaning simply by resiliently spreading apart the rails 20*a* and 20*b* sufficiently to remove the barrel assembly 70, after which the entire bolt assembly is removed by sliding off the open ends of the rails. The receiver plate 17 is preferably stamped from sheet metal such as cold rolled steel for ease and economy of manufacture, and to provide the resiliency necessary to spread apart the rails for assembly and disassembly.

The present conversion apparatus can be used to convert an M-16 for full-automatic fire of 0.22 caliber ammunition by adding the anti-bounce weight 88 and the automatic sear trip 89, both of which are separate elements that fit in place about the conversion apparatus 10 without requiring modification or special installation. The anti-bounce weight 88 in the disclosed embodiment is an approximately hemi-cylindrical member which slides on the upper surface of the receiver plate 17 behind the bolt body 38 and beneath the spring housing 43. The weight 88 has a pair of lower coplanar surfaces 90*a* and 90*b* which slide along the receiver plate, and a radius 92 of a concave surface is provided in the underside of the spring housing 43 so that the top 91 of the weight has a sliding fit with the concave radius 92 of the spring housing. The lateral dimensions of the weight 88 are selected so that the longitudinal edges 93*a* and 93*b* of greatest width, running between the front and the back of the weight, are substantially the same width as the lateral dimension of the receiver plate 17. The weight 88 thus fits within the upper receiver 12 for lateral guidance while undergoing longitudinal sliding movement on the receiver plate.

The weight 88 has a first notch 94 at the back of the top 91, and this notch receives the lug 95 which extends downwardly from the back end 60 of the spring housing 43. The notch 94 provides a limited extent of lost-motion travel between the weight 88 and the bolt assembly 37 for a purpose described below. The weight 88 also has a forwardly-facing notch 96 which provide clearance to allow the hammer of the rifle to strike the firing pin 42.

Figure 11:
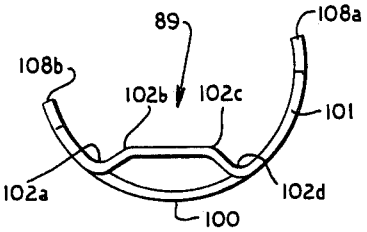
FIG. 11 is an end elevation view of the automatic sear trip, as seen from the right side of FIG. 10.

The automatic sear trip 89 is placed immediately below the receiver plate 17 of the conversion assembly, and is vertically supported by a mating surface (omitted in FIG. 1 for clarity) of the upper receiver 12. The trip 89, which can be fabricated from a single sheet-metal stamping, has a rear trip-engaging member 100 in the shape of a cylindrical hoop segment, and has a forward member 101 in the shape of a cylindrical hoop section having a flattened portion which extends upwardly above the radius of member 100, as best seen in FIGS. 2 and 11, so as to clear the existing bolt catch (not shown) of the M-16. The trip-engaging member 100 and the front member 101 are interconnected by a pair of longitudinally-extending strips 103 and 104. The total arcuate dimension of the front member 101, including the flattened portion 102 and the bends 102*a*, 102*b*, 102*c*, and 102*d*, is preferably the same as that of the trip-engaging member 100, so that the trip 89 can easily be formed by simple stamping and bending operations.

A pair of tabs 108*a* and 108*b* extend upwardly from the top of the trip-engaging member 100, and these tabs are received within mating slots 109*a* and 109*b* in the back portion 18 of the receiver plate 17. The slots 109*a* and 109*b* are longitudinally longer than the corresponding dimension of the tabs 108*a* and 108*b*, thereby providing an extent of lost-motion movement for the trip 89 relative to the receiver plate 17.

The position of the automatic sear trip 89 in assembly is best seen in FIGS. 2 and 4 where the front member 101 is located beneath the bolt body 38 immediately in front of a projection 112 which extends downwardly from the bolt body to lie immediately behind the front member of the trip, when the bolt assembly 37 is in full forward position. The trip 89 thus defines an internal slot or "window" 113 within which the bolt projection 112 is free to travel longitudinally, the longitudinal travel of the trip itself being limited by the lost-motion connection of slots 109*a*, 109*b*, and tabs 108*a*, 108*b*.

When the conversion assembly 10 with the anti-bounce weight 88 and the automatic sear trip 89 are installed in an M-16 as shown in FIG. 1, the trip-engaging member 100 is positioned immediately behind the conventional automatic sear 114 of the rifle. When the bolt assembly 37 is pulled back and then released by the charging handle (not shown) of the rifle, the hammer is cocked in the conventional manner and the top 0.22 round in the conversion magazine 13 is chambered in the conversion barrel assembly 70. Assuming that the selector lever of the M-16 is in position for full-automatic fire when the trigger is pulled and held, the recoil from the first round drives the bolt assembly backward in the manner described above. The automatic sear 114, under the force of its conventional spring, presses against the trip-engaging member 100 to slide the entire trip 89 backwardly at this time, to the maximum extent permitted by tabs 108 and slots 109. A fresh round is chambered as the recoil spring 44 moves the bolt assembly forwardly, and the projection 112 moves forwardly through the window 113 in the trip 89 to contact the front member 101 slightly before the forwardmost travel of the bolt assembly. The trip 89 is thus moved forwardly by the final forward travel of the bolt assembly, causing the trip-engaging member 100 to contact the automatic sear 114 and release the hammer. The newly-chambered round is fired, and the full-automatic firing cycle repeats until the trigger is released or the magazine is emptied.

The disclosed design and construction of the automatic sear trip 89 allows the trip to have a sufficiently low mass so that the trip is reliably moved backwardly by the force of the standard automatic sear spring each time the rifle fires, an important consideration if reliable full-automatic fire of the subcaliber cartridges is to be obtained without replacing the conventional automatic-trip spring of the rifle. An added benefit of the cylindrical hoop shape of the trip-engaging member 100 is that such shape resists damage if it is attempted to close the rifle, immediately after installing the conversion bolt assembly 10, with the firing selector in full-automatic position. The automatic sear of the rifle is in interference with the member 100 under such conditions, and the strength of the hoop configuration prevents the member from being deformed or otherwise damaged by an improper attempt to close the rifle.

The operation of the anti-bounce weight 88 during full-automatic fire is now considered. Assuming that a round has just been fired, the weight 88 is pushed backwardly along the receiver plate 17 by the bolt body 38. Since the back end 60 of the spring housing 43 extends rearwardly beyond the back end 117 of the weight 88, the lost-motion connection provided by tne notch 94 and the lug 95 permits the weight to continue its backward sliding travel after backward travel of the bolt assembly is arrested by contact of the back end 60 with the back plate 19. As the recoil spring 44 commences to move the bolt assembly 47 forwardly, the lug 95 moves forwardly in the notch 94 of the backwardly-traveling weight 88 to contact the weight, so that the rearward momentum of the weight reduces the developing forward momentum of the bolt assembly. This contact with the bolt slows the cyclic firing rate of the weapon conversion apparatus and also reduces possible surging or uneven rates of fire, both of which results are desirable.

The weight 88 is now pulled forwardly by the lug 95 until the bolt body 38 contacts the body 73 of the barrel assembly 70. Since neither the bolt body 38 nor the barrel body 73 are inelastic members, there is a tendency for the bolt assembly to bounce back a short distance immediately after contacting the barrel assembly, and that bounce-back would partially unchamber the round while the hammer was striking the firing pin, leading to a misfire and possible jamming of the rifle. Forward sliding travel of the anti-bounce weight 88 continues for a brief interval after forward travel of the bolt assembly is arrested, however, and the forward end 118 of the weight strikes the back end 119 of the bolt body 38 with sufficient momentum to prevent incipient bounce-back of the bolt assembly. The weight 88 thus eliminates or reduces bolt bounce during full-automatic fire, as well as reducing and controlling the cyclic rate of fire with the present conversion apparatus.

The conversion magazine 13, as best seen in FIGS. 12–15, includes a magazine housing 125 which fits within the magazine well 126 of the M-16 lower receiver 127, and a cartridge magazine 128 which is supported by the magazine housing in proper cartridge feeding relation with the bolt body 38 and the barrel assembly 70. The magazine housing 125 is preferably fabricated from a single flat piece of sheet metal 129 which is bent as at **130*a* and 130*b* to provide upper corners which define the top surface 131 of the magazine housing and is additionally bent as at 132*a* and 132*b*, providing overlapping bottom portions 133 and 134 which have confronting cut-outs, FIG. 15, to form the opening 135 for receiving the magazine 128. A similar magazine-receiving opening is formed in the top surface 131 by stamping, and slots are also provided in the top and bottom of the magazine housing to receive the alignment fins 139*a* and 139*b* of the magazine 128. The magazine 128 is secured to the magazine housing 125** by welding at the locations where the magazine aligning fins pass through the alignment slots in the top and bottom surfaces of the magazine housing.

Figure 12:
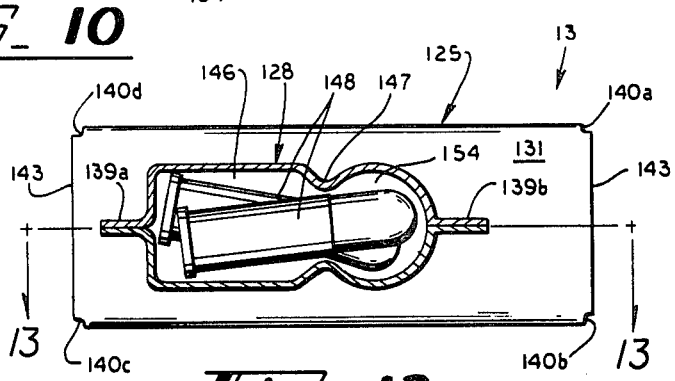
FIG. 12 is a top section view of a magazine for use with the disclosed embodiment of the present invention.
Figure 13:
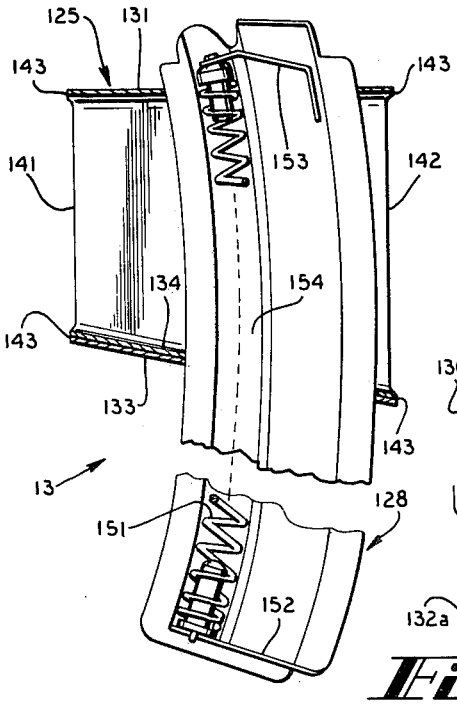
FIG. 13 is a vertical section view taken along line 13—13 of FIG. 12, with cartridges omitted for clarity.
Figure 15:
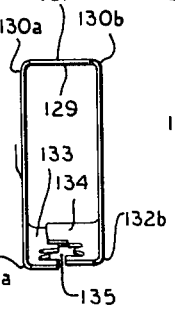
FIG. 15 is a rear elevation view of the housing for the magazine shown in FIG. 12, less the magazine.
Figure 14:
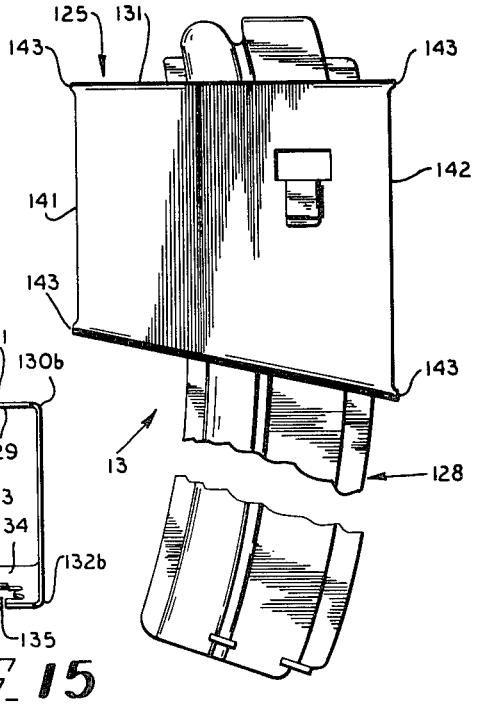
FIG. 14 is a left elevation view of the magazine shown in FIG. 12.

The magazine well of the M-16 rifle has radiuses on each corner, and so it is necessary to provide the magazine housing 125 with cut-away corners **140*a*–140*d*, FIG. 12, to accommodate the radiuses within the magazine well. The cut-away corners are conveniently obtained in the one-piece stamped magazine housing by stamping out a relief portion in the front magazine housing edges, collectively indicated at 141, and in the back edges collectively indicated at 142, as best seen in FIGS. 13 and 14. The top surface 131 and the bottom surface of the magazine housing are thus provided with flat projecting surfaces, collectively designated 143, which contact the front and back wall of the magazine well 126 so as to locate the conversion magazine 13 therein. The relief portions are readily provided by stamping in the flat sheet metal 129 which is bent to form the magazine housing 125**.

A back portion 146 of the magazine 128 is sufficiently wide to receive 0.22 caliber cartridges in side-by-side staggered configuration, and a forward region of the magazine is necked inwardly at 147 to laterally locate the staggered cartridges 148 within the magazine. The magazine is curved forwardly as shown in FIGS. 13 and 14, to accommodate a relatively long magazine spring 151 extending between the floor plate 152 and the cartridge follower assembly 153. The forwardmost part of the magazine 128 is curved to define a generally tubular spring guide channel 154 which contains the coiled magazine spring 151. The disclosed magazine arrangement with side-by-side loading and a forwardly-curved magazine allows magazines of at least thirty rounds capacity of 0.22 caliber ammunition to be accommodated with accurate cartridge feeding in full-automatic fire, while allowing the force of the magazine spring 151 to be sufficiently low to permit hand-loading of the magazine. Of course, magazines of suitable other cartridge capacities can also be fabricated according to the present teachings.

Summarizing the foregoing disclosure, there is shown a conversion bolt assembly apparatus which can be manufactured with relatively little precision machining, apart from the bolt body and the barrel assembly, and yet which accurately defines bolt travel without moving contact with the upper receiver of the rifle. A relatively heavy anti-bounce weight and a relatively light automatic sear trip can be provided for full-automatic operation without otherwise modifying the basic conversion assembly as used for semi-automatic operation. The use of stamped sheet-metal components, both in the conversion assembly and in the conversion magazine, provides a conversion apparatus that can be inexpensively mass-produced for reliable operation.

It will be understood that the foregoing relates only to a disclosed preferred embodiment of the present invention, and that numerous alterations and modifications may be made therein without departing from the spirit and the scope of the invention as defined in the following claims.

I claim:

1. A cartridge magazine for use with a firearm that has a magazine receiving receptacle to accept a magazine containing cartridges of a certain caliber and that has been converted to fire cartridges of a second caliber, said cartridge magazine comprising:

a magazine housing configured to be operatively received in the magazine receptacle of the firearm;

said magazine housing comprising a flat plate which is bent along an upper pair of approximately horizontal laterally spaced apart lines and which is additionally bent along a lower pair of approximately horizontal laterally spaced apart lines so that the spacing on the plate between the upper and lower pairs of bend lines defines the sides of said magazine housing, and so that the lateral separation between bend lines of each said pair respectively defines the top surface and bottom surface of said magazine housing; and a cartridge magazine extending through and attached to said top and bottom surfaces of said magazine housing.

2. A magazine as in claim 1, wherein:

said cartridge magazine has a cartridge receiving cross-section area having a back region sufficiently wide to receive cartridges of said second caliber in staggered array at the rim ends, and an intermediate region which is narrower than said back region so as to maintain said cartridges in substantially nonstaggered alignment at said intermediate region.

3. A magazine as in claim 2, wherein:

said cartridge magazine comprises a forward region defining a spring guide channel which receives and laterally supports a coiled magazine spring; and further comprising a coiled magazine spring disposed within said channel; and follower means slidably received within said magazine and urged upwardly therewithin by said magazine spring so that cartridges in said magazine are contacted and urged upwardly by said follower means.

4. A magazine as in claim 1, wherein:

each of said sides of said magazine housing has a front edge and a back edge; and each of said front and back edges are recessed a distance in relation to the maximum front and back edges of said top and bottom surfaces, so that the front and back edges of said top and bottom surfaces contact mating portions of said receptacle to locate said magazine housing therein without interference of said recessed edges with confronting portions of said receptacle.

* * * * *